US006176388B1

(12) United States Patent
Orndorff

(10) Patent No.: US 6,176,388 B1
(45) Date of Patent: Jan. 23, 2001

(54) COMBINATION LITTER CONTAINER AND DISPLAY DEVICE

(76) Inventor: John Mitchell Orndorff, 166 Bufflick Rd., Winchester, VA (US) 22602-4538

( * ) Notice: Under 35 U.S.C. 154(b), the term of this patent shall be extended for 0 days.

(21) Appl. No.: 09/519,360

(22) Filed: Mar. 6, 2000

(51) Int. Cl.[7] ..... G09F 23/00
(52) U.S. Cl. ..... 220/662; 220/908; 220/908.3
(58) Field of Search ..... 220/662, 908, 220/908.3

(56) References Cited

U.S. PATENT DOCUMENTS

| | | | | |
|---|---|---|---|---|
| 1,108,066 | * | 8/1914 | Cooke et al. | 220/908 X |
| 1,364,209 | * | 1/1921 | Richardson | 220/908 X |
| 1,380,252 | * | 5/1921 | Richardson | 220/908 X |
| 1,424,520 | * | 8/1922 | Richardson et al. | 220/908 X |
| 2,490,790 | * | 12/1949 | Emerson | 220/908 X |
| 3,057,506 | * | 10/1962 | Wetlesen | 220/908 X |
| 3,096,900 | * | 7/1963 | Breneman | 220/908 X |
| 3,681,867 | | 8/1972 | Bilodeau . | |
| 3,793,756 | | 2/1974 | Kay . | |
| 3,803,738 | | 4/1974 | Weiss . | |
| 3,866,824 | | 2/1975 | Lewis . | |
| 3,947,985 | | 4/1976 | Skrzypczak . | |
| 5,351,851 | * | 10/1994 | Powell | 220/662 X |
| 5,772,063 | | 6/1998 | Gantz-Bloome . | |
| 5,967,355 | * | 10/1999 | Ragot | 220/908 X |

OTHER PUBLICATIONS

Continental catalog 1998, p. 21.

* cited by examiner

*Primary Examiner*—Steven Pollard

(57) ABSTRACT

A combination litter container with multiple door/panels 18 each having a display recessed portion 20 between its vertical walls. The poster display device 10 is made of a flexible clear material with tabs 40 that can be inserted into interlocking slotted openings 22 which have a retaining hook 42 internal to said container walls. The bending of said poster display device 10 is such that it both retains the device in position and reduces the glare of direct sun light reflected.

5 Claims, 9 Drawing Sheets

COMBINATION LITTER CONTAINER AND DISPLAY DEVICE

CROSS-REFERENCE TO RELATED APPLICATIONS

Not applicable.

BACKGROUND—FIELD OF INVENTION

This invention relates to litter and trash containers, specifically to such containers that are equipped with display devices. These display devices allow for the viewing of advertisements of products, services and upcoming events.

BACKGROUND—DESCRIPTION OF PRIOR ART

This invention relates to litter containers for receiving waste materials in public places and exhibiting display materials, such as advertising and public service posters. More particularly this invention relates to improved display devices specially constructed to dissuade tampering and vandalism of said posters.

In the past, posters, handbills, and other such advertisements were pasted to the outside surfaces of litter and trash containers. As the elements and vandals did damage to said posters, it became increasingly necessary to provide a means of protection from theft and destruction of these advertisements. In the pasts as well as now, the posters of upcoming movies or concerts have become collectors items and as such are frequently removed by thieves before the actual event, forcing the owner of the establishment to replace the posters at additional cost to the owner.

In the past, a variety of display devices have been used to prevent the vandalism, theft or destruction by the elements of the posters. Several types of trash containers with a clear plastic panel have been proposed—U.S. Pat. Nos. 5,772,063 (1998), 3,793,756 (1974), 3,866,824 (1975). These usually require a key for entry to load and unload the poster, as well as a key entry to remove trash. Many of these devices are difficult to use with thin posters or during windy conditions. The clear cover sheet is hinged, or the poster must slide down into a channel. This requires in either instance, a poster to be printed on thick paper stock, precluding the use of thin stock posters, thereby adding to the cost. The inserting of said poster into the device may not always allow for proper orientation because the cover panel is hinged and the poster may move during the closure of the panel. The end result can be a skewed poster within the display. Several devices rely upon the poster to be make of sufficiently thick card stock and even a particular width to allow it to slide down into channels within a frame, forcing a width constraint upon all posters that are to match with these displays.

In most of the display designs, the outside is protected by a flat sheet of clear plastic. While providing protection, the flat sheet in sunny conditions allows glare to hide the message behind the sheet, thereby defeating the usage of said device. Many containers are decorated with the name of the establishment that purchased said container. The name decoration will show through the cover sheet when a poster is not in place. If the sheet is flat, the result in sunlight is the same: obstruction of visibility.

Accordingly, a primary object of this invention is to provide a more vandal resistant poster display device for litter containers. It facilitates the installation of posters without a key and reduces the glare on the cover sheet, thereby providing a more readable device.

SUMMARY

In accordance with the present invention a combination litter container and display device comprises a display panel with a wicket, a poster display device, and an attachment device to secure the poster display device.

OBJECTS AND ADVANTAGES

Accordingly, besides the objects and advantages of the combination litter container and display device, several objects and advantages of the present invention are:

(a) to provide a design that does not require tools or a key to facilitate installation of a poster display device;

(b) to provide a method to secure the alignment of posters, handbills and small assorted and/or odd sizes advertisements prior to the attachment of the display device to the litter container;

(c) to provide a method to allow the display device to be loaded with advertisements indoors, especially during inclement weather, before the display device is attached to the litter container;

(d) to provide multiple sheet protection to display panels when logos are printed directly onto the display recess;

(e) to provide protection against the elements and theft of posters within the display device;

(f) to provide a glare reduced front panel to improve the readability of the posters or printed display panels in direct sunlight;

(g) to provide a design that hides fasteners and hardware used in the attachment of the display device.

(h) To provide a means of protection to the display recess as well as the posters that deny access to those without a key.

DRAWING FIGURES

In the drawings, related figures have the same number and subassemblies have separate numbers to designate their usage.

FIG. 1 shows a litter container with a hinged front door, which can be locked with a key in the closed position. Said container may also have a similar door/panel on the opposite side or on all sides of the litter container. Also shown is a poster display device.

Figure 1:
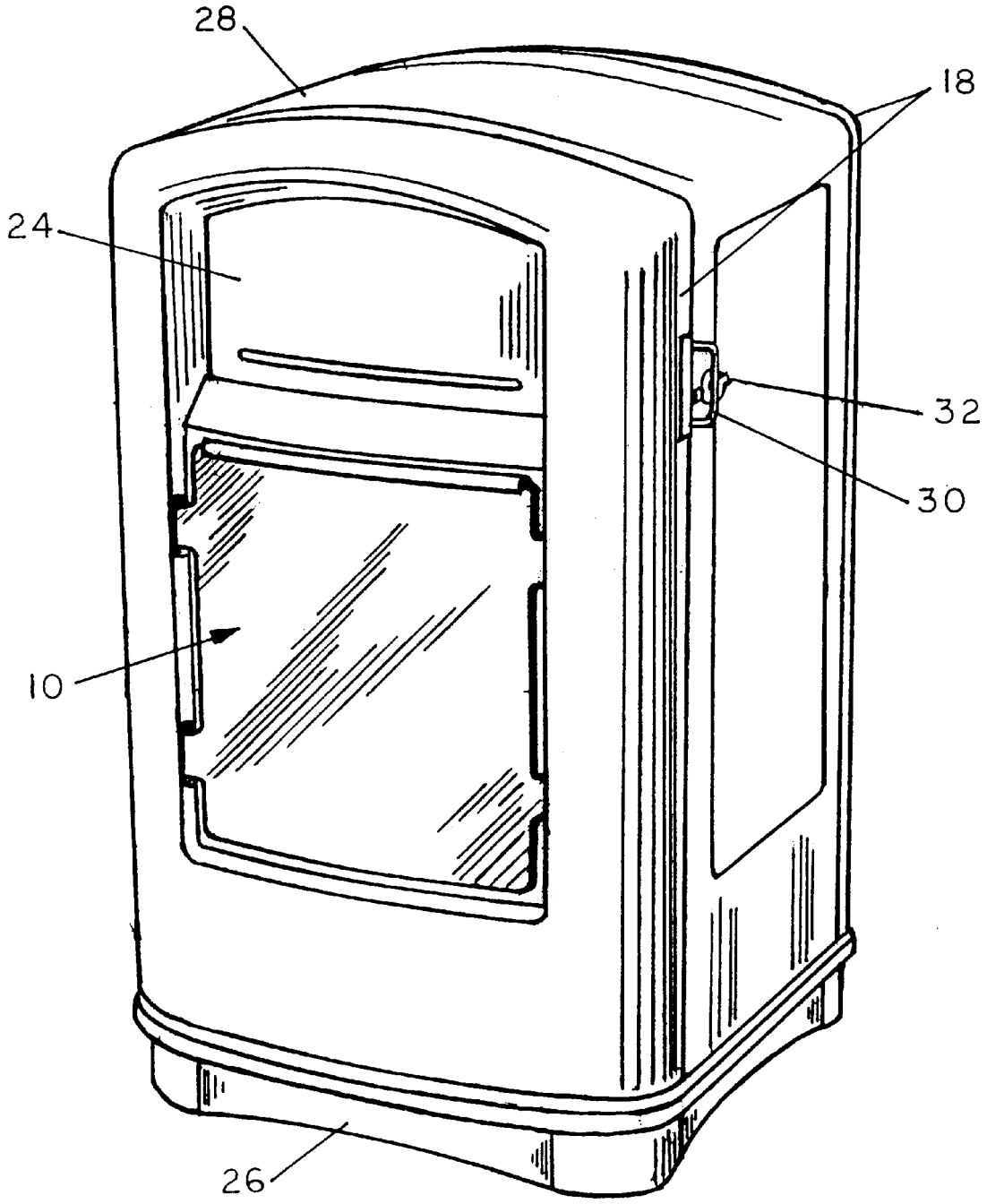

| Reference Numerals in Drawings | |
|---|---|
| 10 poster display device | 12 "U" shaped gasket |
| 14 cover | 16 cover |
| 18 door/panel | 20 display recess |
| 22 slotted opening | 24 wicket |
| 26 container base | 28 container sides |
| 30 handle | 32 lock (key operated) |
| 34 retaining slot | 36 display poster |
| 38 hinge | 40 cover tab |
| 42 retaining hook | 44 top litter entry |
| 46 retaining hook bracket | 48 screw |

DESCRIPTION

Figure 2:
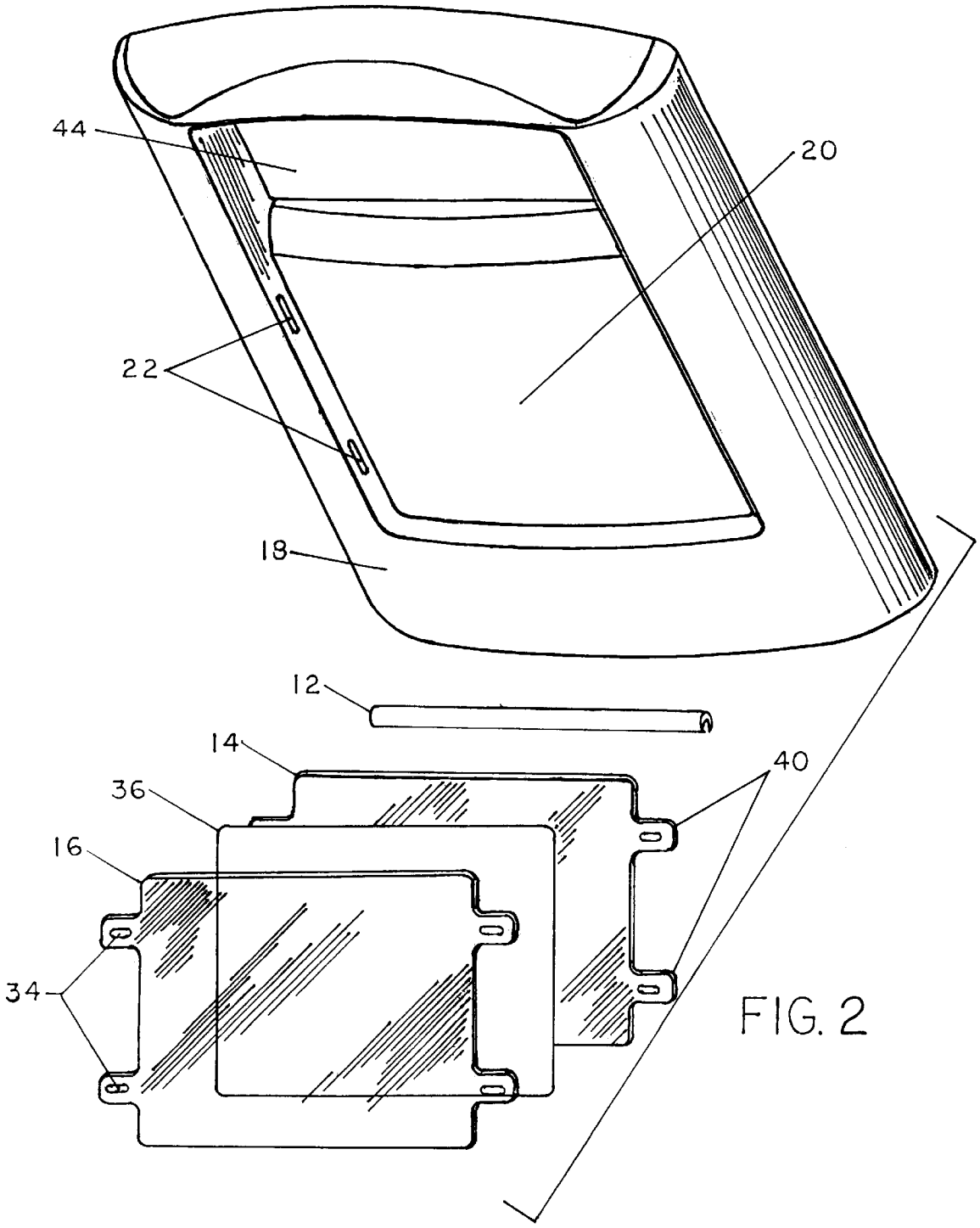
FIG. 2 shows an isometric exploded view of the principle components comprising the poster display device.

FIGS. 1 and 2—Preferred Embodiment

A preferred embodiment of the poster display device and litter container of the present invention is illustrated in FIG. 1 (front perspective view), and FIG. 2 (front isometric view of principle components). The poster display device has two identical covers 14 and 16 both of a uniform cross section consisting of an optically clear, flexible sheet of material which can be repeatedly bent and straightened out without fracturing. The covers 14 and 16 have tabs 40 made of the same material with retaining slots 34 machined in tabs 40. A thin display poster 36 is located between said covers 14 and 16. A single grooved "U" shaped gasket 12 consisting of flexible, water resistant material which can be repeatedly bent and straightened out without fracturing and has a groove of sufficient size to overlap cover 14, display poster 36, and cover 16 once they are sandwiched together. A rigid display door/panel 18, a display recess 20, and multiple slotted openings 22 of such number as to match the number of tabs 40 as appears on covers 14 and 16, comprises one of the litter container sides. The display door/panel 18 as shown utilizes a wicket 24 (FIG. 1) in conjunction with a top litter entry 44. The door/panel 18 as shown (FIG. 2) is with only a top litter entry 44. A stationary container side 28 of construction similar to said display door/panel 18 is attached to container base 26 by fasteners. Stationary container sides 28 attach to display door/panel 18 either by fasteners or via a hinge 38 (FIG. 4) at one side and a lock 32 on the other side, thereby securing the display device components together. The display door/panel 18 that is attached with hinge 38 is equipped with a handle 30 for ease of use. Display door/panel 18 may appear either once or a multiplicity of times as a container side. The cover tabs 40 with retaining slots 34 are sized such that they may freely pass through slotted openings 22 that are located in the display recess sides of display door/panel 18. The aforementioned reference numerals comprise the poster display device 10 as shown in FIG. 2. The poster display device 10 is attached to display door/panel 18 and thereby to the remaining container sides 28, as shown in FIG. 1. with this litter container example comprised of two display door/panels 18.

Figure 3:
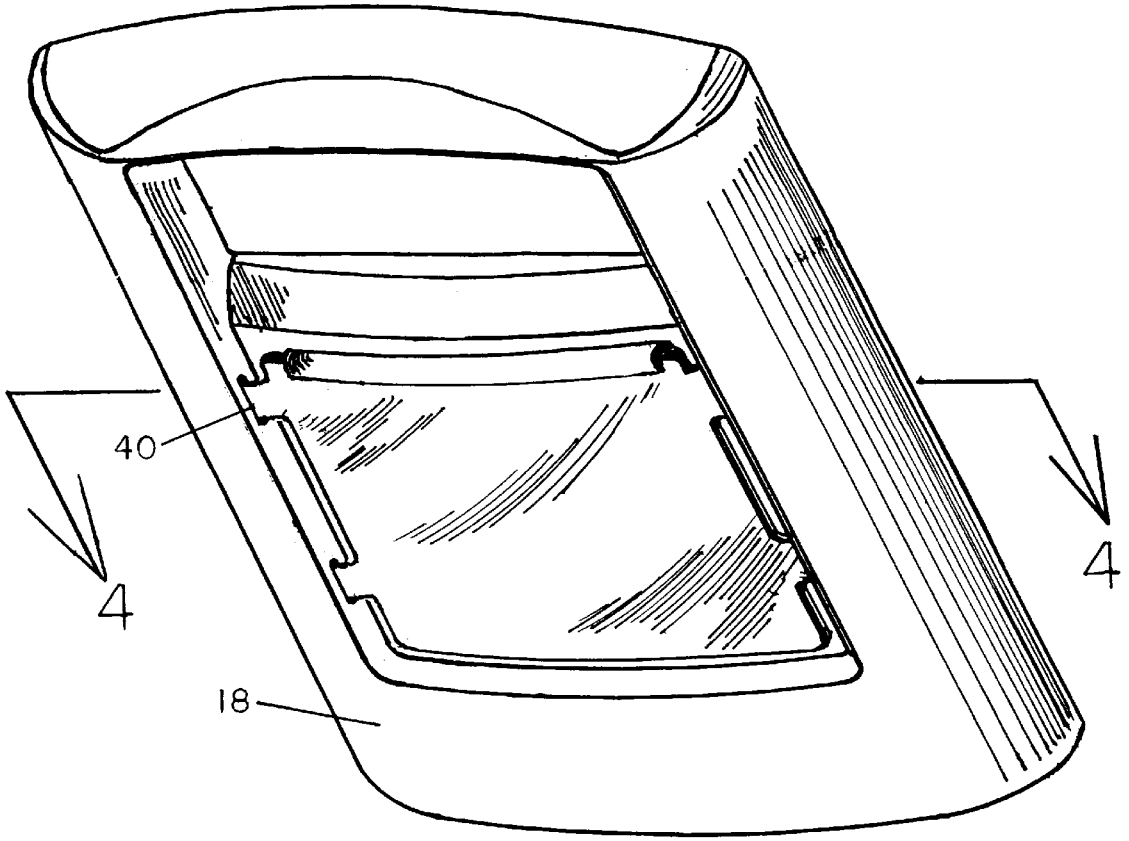
FIG. 3 shows an isometric view of the principle components of the invention in the assembled position.
Figure 4:
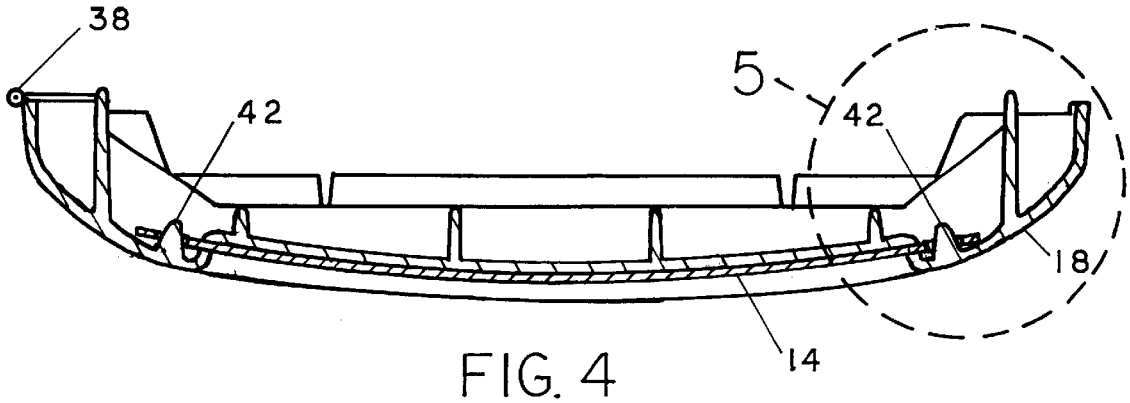
FIG. 4 shows a sectional view as it would be cut through the center of the tabs and slots of the covers as well as the center of the slotted openings in the door/panel. Reference detail of the portion indicated by the section lines 4—4 as shown in FIG. 3.
Figure 5:
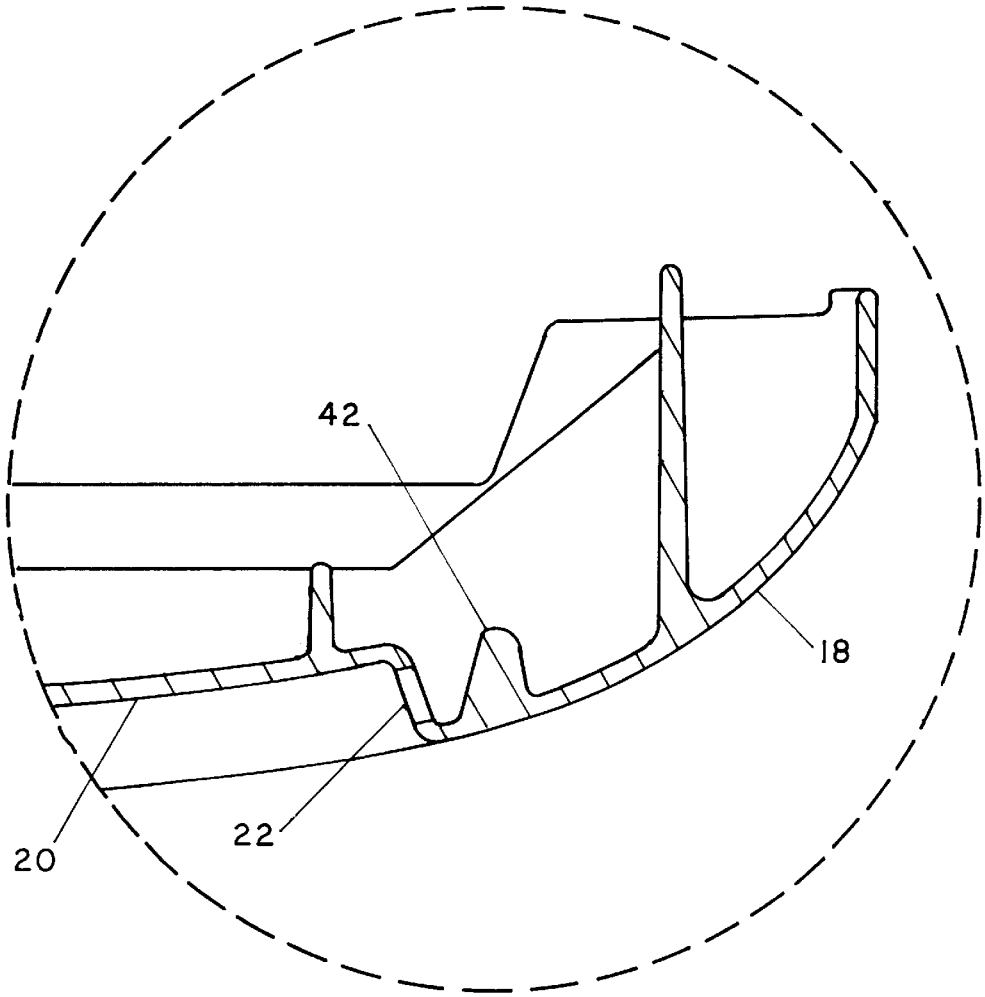
FIG. 5 shows an enlarged detail of the portion indicated by the dashed circle as shown in FIG. 4. Note the display panel cover(s) and poster have been omitted for clarity.
Figure 6:
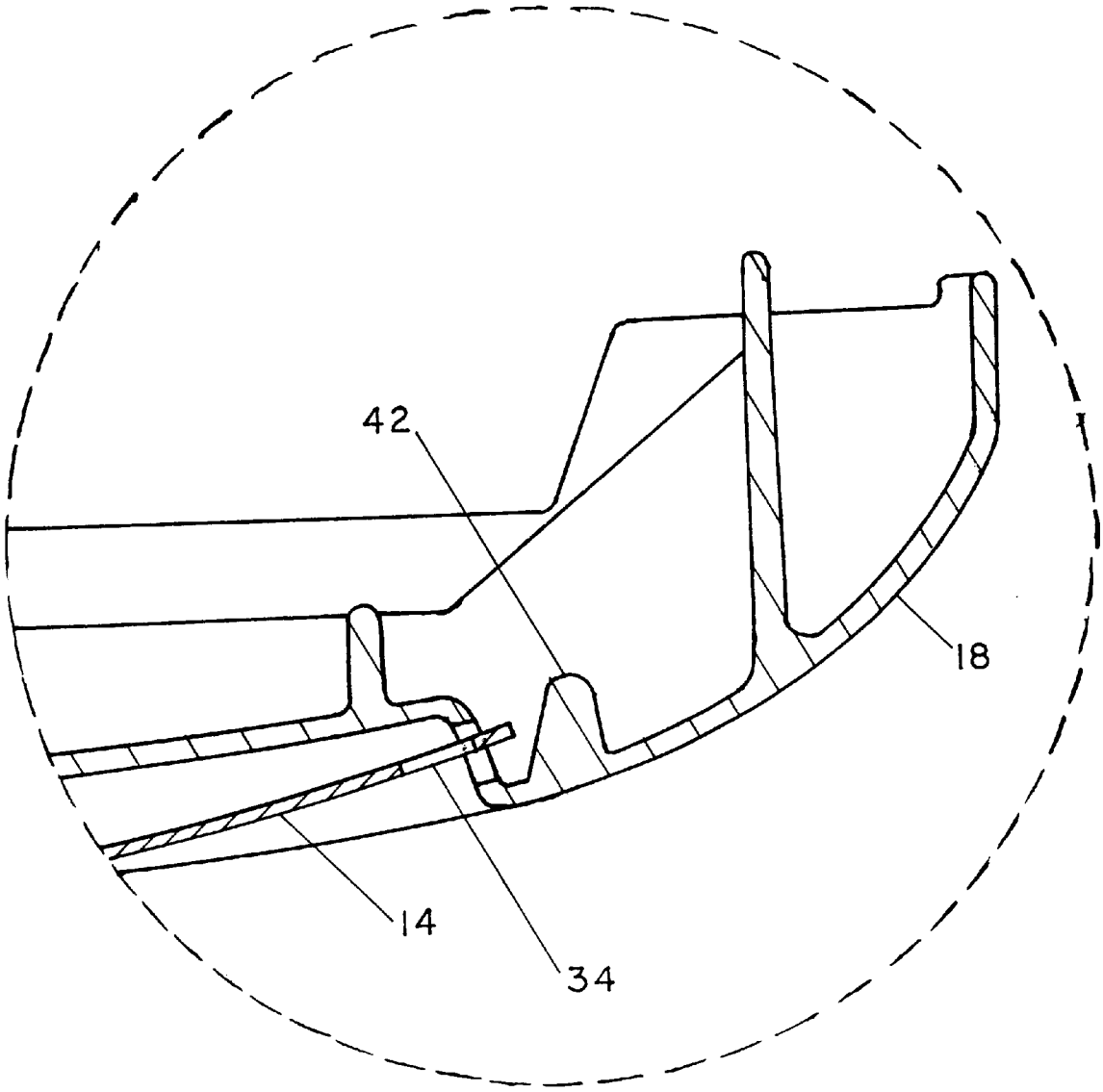
FIG. 6 shows the same detail as shown in FIG. 5 but with cover being inserted into slotted opening in container door/panel.
Figure 7:
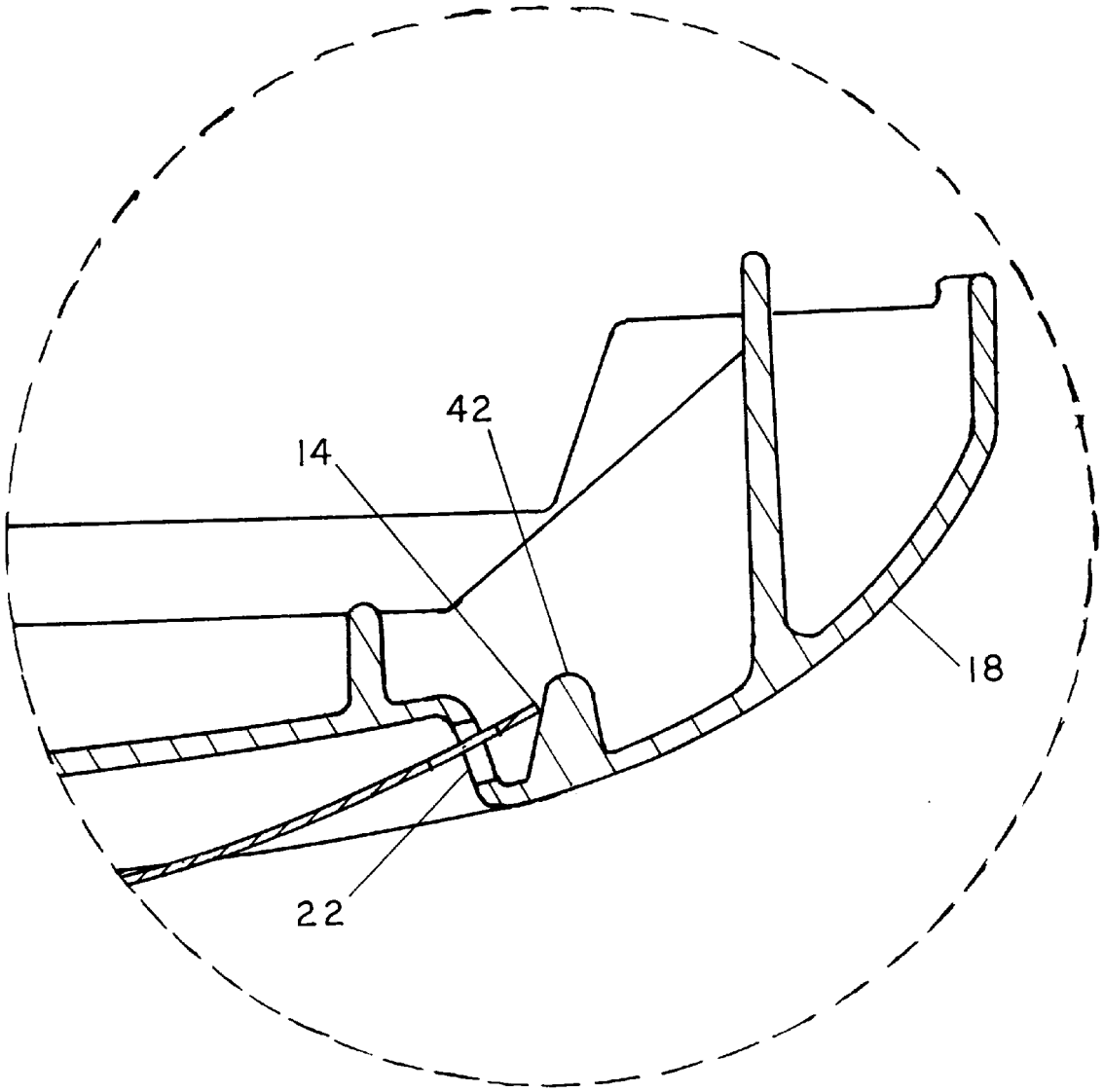
FIG. 7 shows the same detail as FIG. 6 but with the cover engaging and riding up the ramp of the retaining hook.

FIGS. 3–4—Additional Embodiments

There are various possibilities with regard to the methods of protection provided by cover 14 and cover 16. Said covers may be utilized to protect either poster 36 or display recess 20. The sandwiched construction of poster 36 between cover 14 and cover 16 along with "U" shaped gasket provides protection of poster 36 against rain and snow. The usage of a single cover either 14 or 16 provides protection of any graphics printed on display recess 20 of door/panel 18 against vandalism by covering said surface.

Operation FIGS. 5, 6, 7, 8, 9

Figure 8:
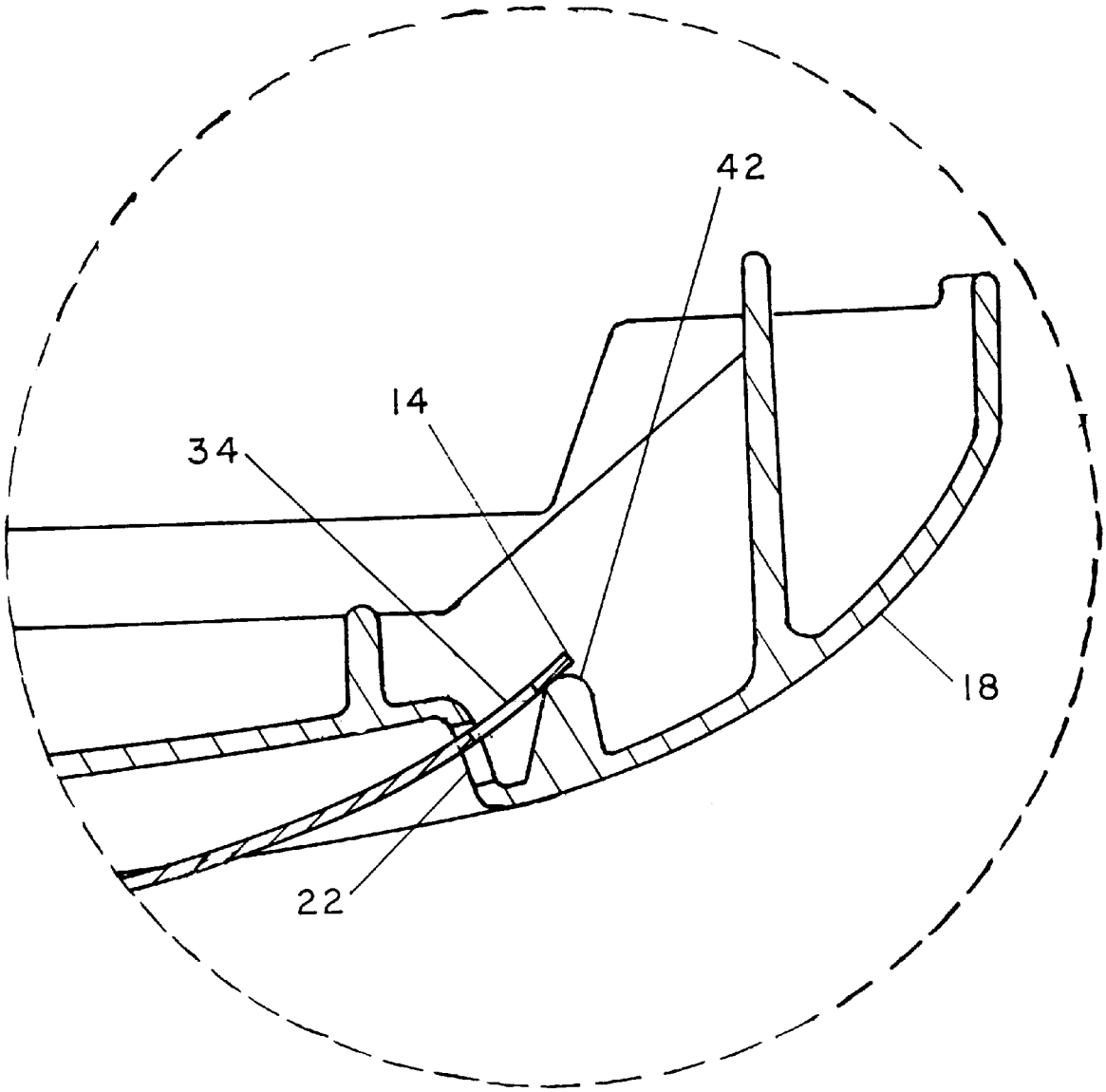
FIG. 8 show the same detail as FIG. 7 but with the cover riding over the top of the retaining hook just prior to the hook entering the slot in the cover.
Figure 9:
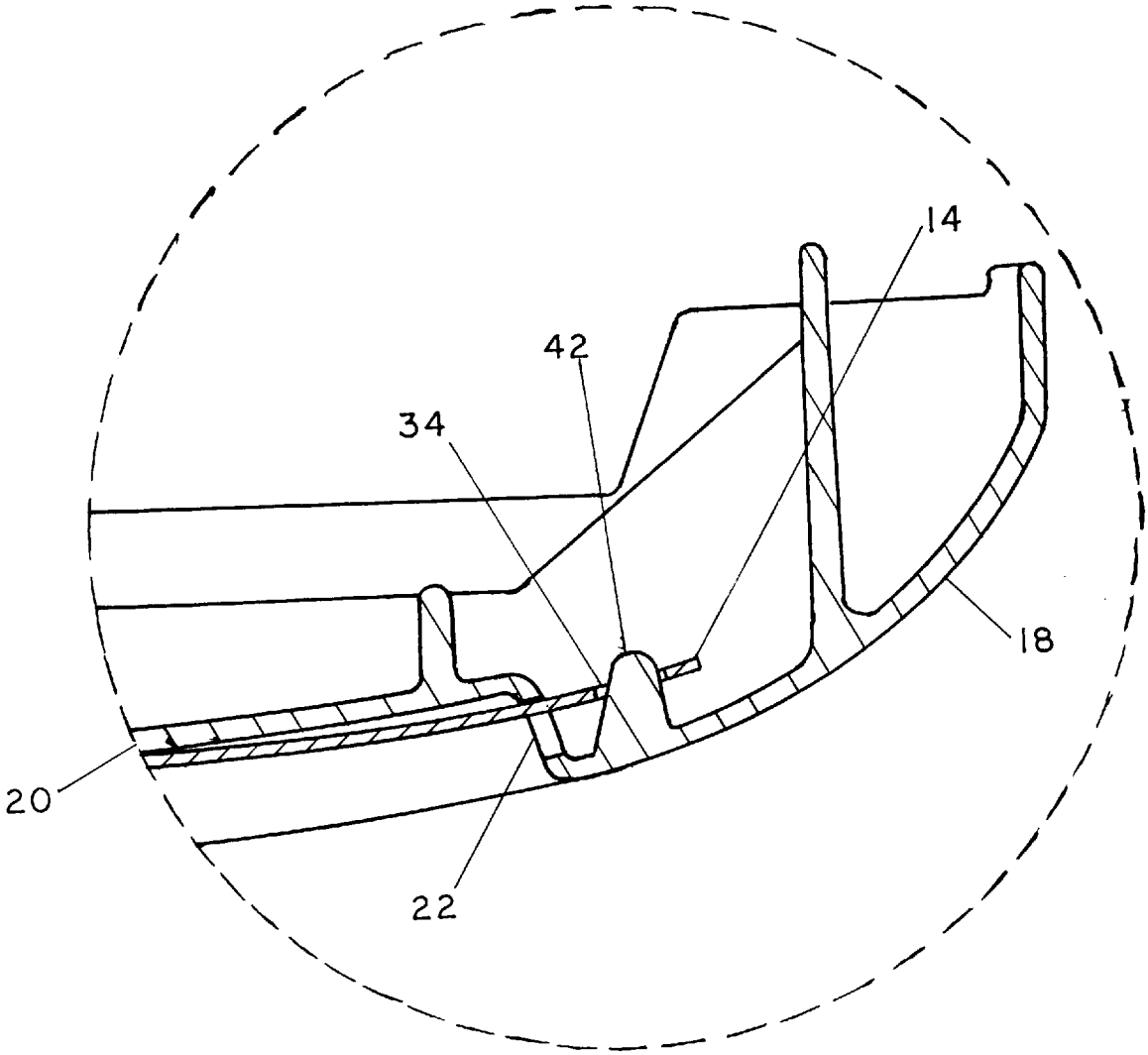
FIG. 9 shows the same detail as FIG. 8, but with the cover in its fully installed position, trapped behind the retaining hook. Note: the curvature of the cover as installed.

The manner of installing and using the poster display devise 10 or either singular covers 14 or 16 is the same. Section of door/panel 18 shown (FIG. 5) with other components omitted for clarity has section positioned through the center of slotted openings 22. The installation can be completed without unlocking door/panel 18 from container sides 28. As shown, one inserts cover tab 40 into slotted opening 22 in door/panel 18. (FIG. 6) As the cover 14 is inserted farther into slotted opening 22 it eventually makes contact with ramped surface of retaining hook 42. (FIG. 7) As shown in FIG. 8, cover tab 40 slides inwards and upwards on ramped surface of retaining hook 42. Once the retaining slot in cover tab 40 clears retaining hook 42, cover tab 40 and the cover 14 flex back to almost a flat shape, thereby locking cover tab 40 behind retaining hook 42. (FIG. 9). This secures the cover 14, or the entire poster display device 10 when a poster 36 is utilized for advertisements.

Description

Figure 10:
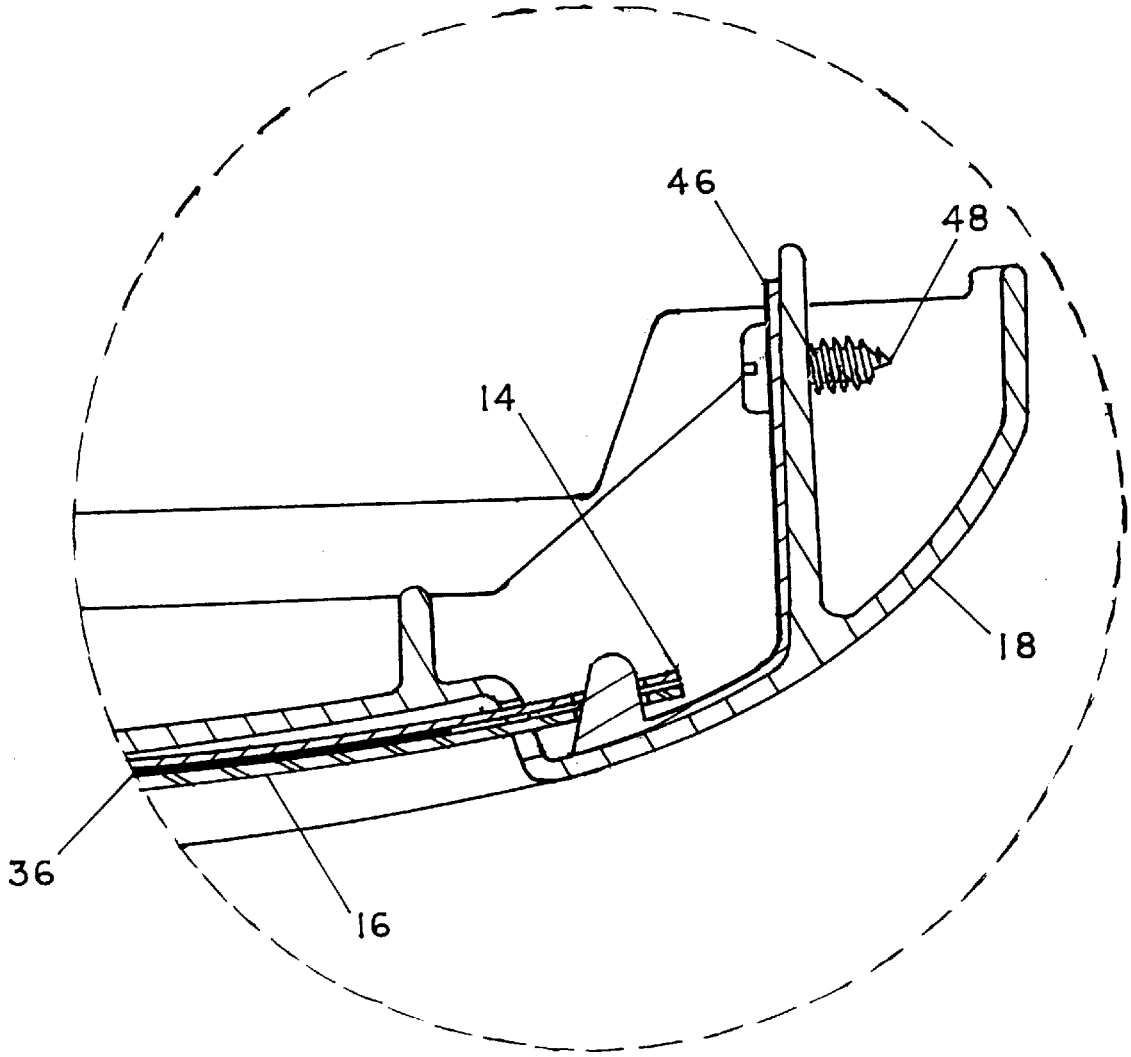
FIG. 10 shows alternative embodiment for the retaining hooks. This figure also shows the sandwiched construction of both covers and a poster in the installed position.

FIG. 10—Alternative Embodiment

There are various possibilities of providing a retaining hook 42 that effectively functions as a secure attachment to display door/panel 18. The locking tab bracket 46 is formed from sheet metal and is mechanically fixed in position by fasteners, a screw 48 is just one such example. The retaining hook bracket 46 has the same general shape and thereby the same function as a molded in version of retaining hook 42. There are alternative possibilities for the use of the display device 10 and as it is depicted in the locking position it secures poster 36 secure from theft and when used in conjunction with "U" shaped gasket 12, protects poster 36 from the elements.

Conclusion, Ramifications, and Scope

Accordingly, the reader will see that the display device of this invention can be used to provide easy installation of display posters and provide protection to both the container doors and panel. This display device reduces the need for tools or key to open locks/doors when installing the covers. The size and arrangement of handbills are not dictated by the display devise nor are they required to be of any particular thickness as well to function between the covers. The only way to release the cover tabs is through entry gained by persons with the proper key. Since the elements are unable to destroy the posters, the posting of the event or sale can be observed in the display device right up until the proper time to pull the notice. Many other designs utilize a flat clear plastic sheet for protection, however, due the slight curvature of this design, the readability in high sun light situations is greatly increased, thereby permitting the passerby to read the notice as desired.

What is claimed as new:

1. A combination litter container and display device comprising:

a. a self-standing outdoor solid waste receptacle comprising a walled enclosure, at least one vertical door/panel with a wicket for receiving trash and a recessed portion below providing a display device for receiving display posters.

b. a poster cover comprised of water clear, flat, flexible sheet material which can be repeatedly bent and straightened without cracking.

c. A gasket consisting of flexible water resistant material which can be repeatedly bent and straightened without fracturing and having a groove of sufficient size to overlap two of the aforementioned poster covers and a poster sandwiched betwixt.

2. The container and display device of claim 1 above wherein said means for display attachment is accomplished with poster covers slidably engaging matching geometry in said recessed portion of vertical door/panel.

3. The display device of claim 1 above comprised of a flat sheet with a multiplicity of tabs which engage respective slots on said vertical walls of recessed portion of vertical door/panel with receiver shapes in the multiplicity of tabs that allow an interlocking action with retaining hooks situated internal to said container walls and in alignment with said receiver shapes in said tabs.

4. The container of claim 1 including a lock co-operating with said door/panel for locking the container.

5. The door/panel of claim 1 wherein said recessed portion of vertical wall has a curvature whereby said poster cover flat sheet is contiguous on said curved surface which forces tabs into said interlocking action thereby facilitating locking of poster display device.

* * * * *